US006632130B1

(12) United States Patent
Whiting

(10) Patent No.: US 6,632,130 B1
(45) Date of Patent: Oct. 14, 2003

(54) ABRADE AND CUT DISC

(76) Inventor: Thomas Whiting, 233 Lakesshore Dr., Marlborough, MA (US) 01752

( * ) Notice: Subject to any disclaimer, the term of this patent is extended or adjusted under 35 U.S.C. 154(b) by 0 days.

(21) Appl. No.: 09/862,753

(22) Filed: May 22, 2001

Related U.S. Application Data

(60) Provisional application No. 60/206,336, filed on May 23, 2000.

(51) Int. Cl.[7] ..... B24B 7/16

(52) U.S. Cl. ..... 451/545; 451/541; 451/521

(58) Field of Search ..... 451/28, 461, 541, 451/548; 83/676, 837

(56) References Cited

U.S. PATENT DOCUMENTS 2,288,624 A * 7/1942 Holmsten ..... 451/539
2,682,735 A * 7/1954 Buckner ..... 451/539
3,046,709 A * 7/1962 Cook ..... 451/510
3,353,308 A * 11/1967 Zane ..... 451/529
3,716,950 A * 2/1973 McClure ..... 451/546
4,338,748 A 7/1982 Elbel
4,683,683 A * 8/1987 Block ..... 451/509
5,036,714 A * 8/1991 Christoffers et al. ..... 73/862.57
5,241,794 A 9/1993 Pedersen et al.
5,408,983 A * 4/1995 Sawluk ..... 125/15
5,465,706 A * 11/1995 Sawluk ..... 125/15
5,520,569 A * 5/1996 Endoh ..... 451/15
5,529,528 A * 6/1996 Young et al. ..... 451/28
5,704,828 A 1/1998 Young et al.
5,879,504 A 3/1999 Winter
5,931,729 A 8/1999 Pentilla et al.
5,989,114 A 11/1999 Donahue et al.
6,079,302 A * 6/2000 Gudleske ..... 82/47

* cited by examiner

*Primary Examiner*—M. Rachuba
(74) *Attorney, Agent, or Firm*—Perkins Smith & Cohen LLP; Peter J. Borghetti

(57) ABSTRACT

A tool adaptable for use with a power drill for the duel purpose of sanding and cutting a work piece without changing tools. The tool includes two components, one for cutting and one for abrading, which are reduced in diameter as required in order to provide suitable cutting and abrading surfaces for future use.

13 Claims, 8 Drawing Sheets

ABRADE AND CUT DISC

CROSS REFERENCE TO RELATED APPLICATIONS

This application claims priority of Provisional Application No. 60/206,336, entitled Abrade and Cut Disc filed on May 23, 2000, and which is incorporated herein by reference.

BACKGROUND OF THE INVENTION

This invention relates generally to sanding, grinding, and cutting appliances adaptable to power drills, and, more particularly to a single, disposable tool used for both abrading and cutting of work surfaces, such as painted automotive panels.

A common operation for working various surfaces is to first use a commercial sanding disc to remove imperfections from a surface and to then switch to a grinding disc for the metal cutting operation. The constant changing of discs are undesirable for various reasons including cost and inefficiency. Also, the sanding surface outer edges become worn and non-functional for the intended purposes and the sanding pad is thrown away with good sanding surface inboard to the center of the pad.

It is therefore an object of this invention to provide a single power disc that comprises a sanding surface and a cutting surface.

It is a further object of this invention to provide a disc that will maximize the life of the sanding surface.

It is still a further object of this invention is to speed the grinding process by using the same disc for multi-surface auto body repair.

It is even another object of this invention is to save work time by eliminating the constant changing of abrade and cut discs.

It is still another object of this invention is to use less tools, thereby, reduce operating expenses.

It is a further object of this invention is to provide a longer lasting disc than traditional auto body discs.

It is still a further object of this invention to provide a disc that can get into small places.

It is another object of this invention to provide a multipurpose disc used on flat or angled places.

SUMMARY OF THE INVENTION

The objects set forth above as well as further and other objects and advantages of the present invention are achieved by the embodiments of the invention described hereinbelow.

In one embodiment, a support holds a circular replaceable, disposable abrading/cutting disc on a powered drive tool for rotation about the wheel's central axis. The cutting plate is also the pressure-applying backing plate of the abrading pad made of a suitable firm material. In operation, the pad is positioned the work surface and then rotated. When the disc is held at a slight angle to the work surface, the outer section of the abrading surface engages the work surface. When the disc is held perpendicular to the work surface, the outer edge of the disc is the cutting surface which cuts materials such as metal, plastic and the like. As the abrading pad wears with use, a new outer abrading pad section is realized as the outer diameter of the disc is reduced, thereby, removing the worn abrading pad surface.

The longevity of the abrading/cutting disc is increased by utilizing all the abrading surface.

The present invention includes a combination abrade and cut wheel that saves the operator from having to change from one pad to another during the metal working operation. Thus, both the abrading and cutting operation may be achieved with the same disc and in a very short period of time without having to change machines or adding or removing surfaces to a single machine. The disc is generally circular-shaped, having a central axis of rotation R—R, comprising an abrading surface and a cutting edge.

One embodiment discloses the abrading surface and cutting edge as an integral single disc. While another embodiment discloses a two-piece configuration with the abrading surface removable from the cutting edge. Both embodiments are acceptable depending on application For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

Figure 1A:
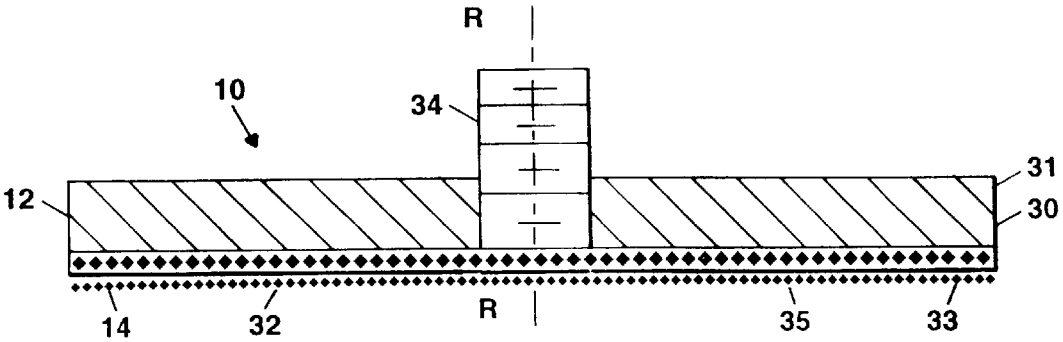
FIG. 1*a* shows a partial cross-section of the preferred embodiment.
Figure 1B:
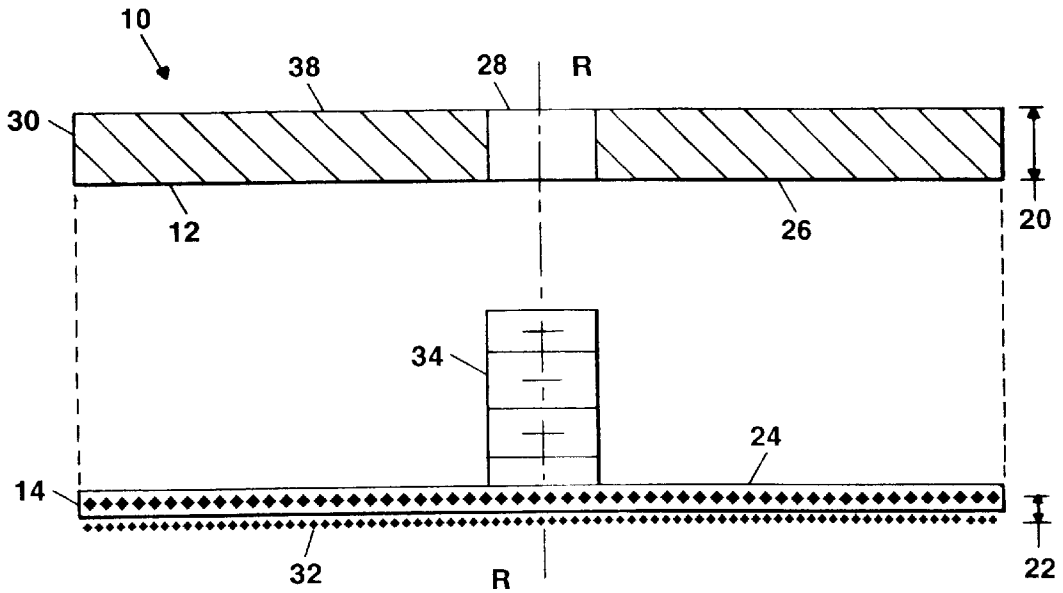
FIG. 1*b* shows an exploded partial cross-section view of the preferred embodiment.
Figure 2:
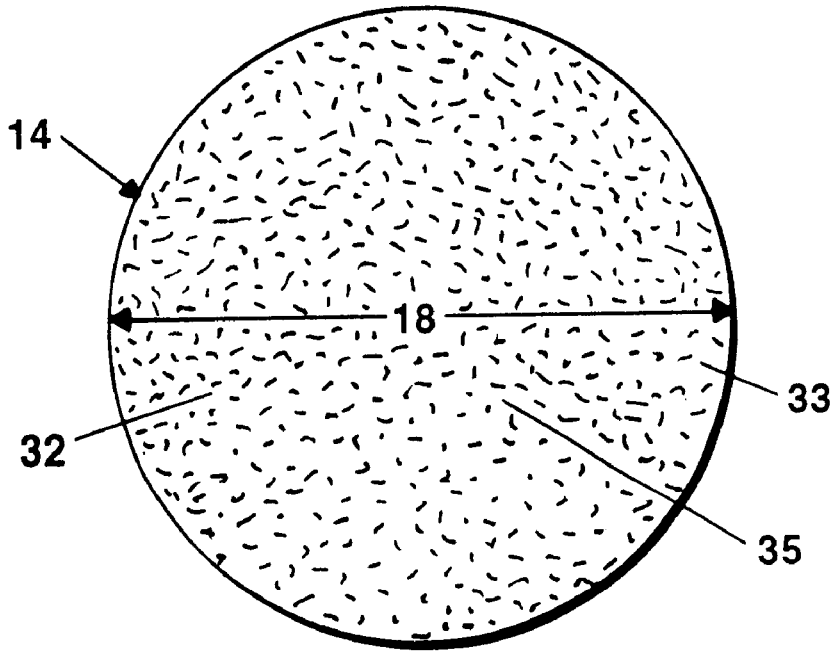
FIG. 2 is a bottom view of the abrading pad illustrating the abrading surface.
Figure 3:
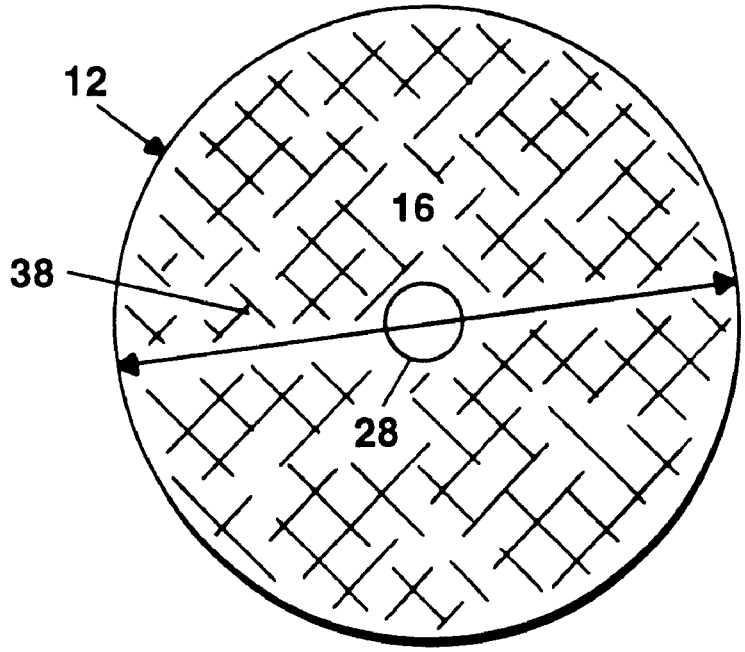
FIG. 3 is a top view of the cutting plate.

In one exemplary embodiment of this invention an abrade and cut disc 10 is made of a two-piece configuration adaptable to a power drill for the dual purpose of sanding and cutting a work piece without changing a tool. The cutting plate 12 and the abrading pad 14 have a common central axis of Rotation R—R (as illustrated in FIGS. 1*a* and 1*b*) and are generally planar and circular in shape (as illustrated in FIGS. 2 and 3). The abrade and cut disc 10 includes an externally threaded connection 34 (see FIGS. 1*a* and 1*b*) for removable attachment to an internally threaded locking device (not shown) of a drive mechanism (see FIG. 4) of, for example, a power drill.

Referring now to FIGS. 1*a* and 1*b*, the cutting plate 12 is preferably made of any suitable material such as graphite or the like sufficient to cut metal, and wear such that the cutting plate edge surface 30 at the perimeter 31 of the abrade and cut disc 10 is radially cut back to utilize all the abrading surface 32 (to be discussed in detail below) of the abrading pad 14. It is also desirable that the cutting plate 12 be made of a firm but somewhat resilient material to provide a degree of flexibility to facilitate a good, well distributed application of pressure to the abrading surface 32, thereby acting as the pressure-applying backing plate of the abrading pad 14.

The cutting plate 12 is generally thin, planar, and circular with axially opposing forward 26 (FIG. 1*b*) and rearward faces 38 (FIGS. 1*b* and 3) having a cutting plate diameter 16 (FIG. 3) and cutting plate thickness 20 (FIG. 1*b*). The cutting plate 12 further comprises a central hole 28 (FIGS. 1*b* and 3) for receiving the externally threaded connection 34 (to be discussed below) of the abrading pad 14. The combination abrade and cut disc 10 is screwed onto the output shaft of the drive mechanism (not shown).

The abrading pad 14 is generally a thin circular piece that has opposed generally planar surfaces, the abrading pad rear face 24 (FIG. 1*b*) and the abrading surface 32 (FIGS. 1*a*, 1*b*, and 2), having pad diameter 18 (FIG. 2) and an abrading pad thickness 22 (FIG. 1*b*).

As illustrated in FIGS. 1*a* and 1*b*, the abrading pad 14 includes an externally threaded connection 34, which is fixedly attached to the abrading pad rear face 24 approximately at the center of rotation R—R, designed to thread on to a standard automotive type drive mechanism (not shown), but is adaptable to any drive mechanism. The externally threaded connection 34 can be manufactured integral to the abrading pad 14 by injection molding or equivalent or can be a separate part (not shown) welded or adhered to the abrading pad rear race 24. The externally threaded connection 34 passes through central hole 28 of cutting plate 12, and removedly secures the abrade and cut disc 10 to a drive mechanism.

Figure 4A:
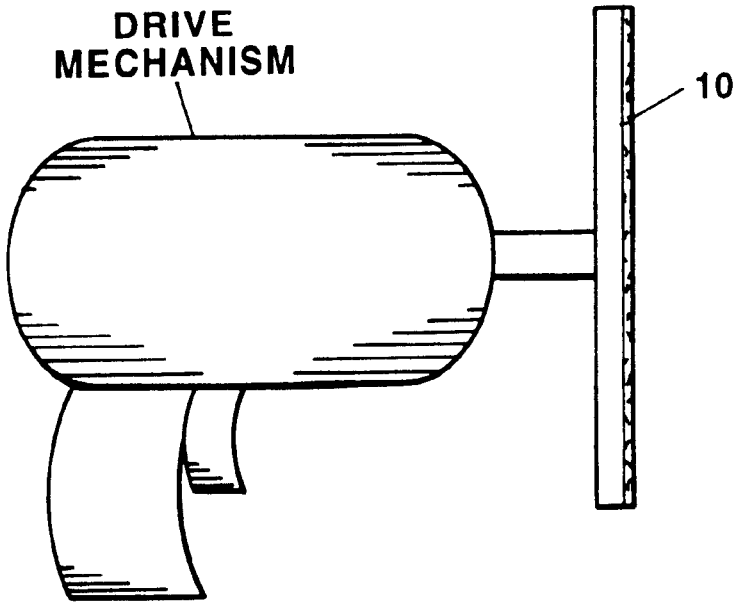
FIG. 4*a* is a side view of the abrade and cut disc adapted to a drive mechanism.
Figure 4D:
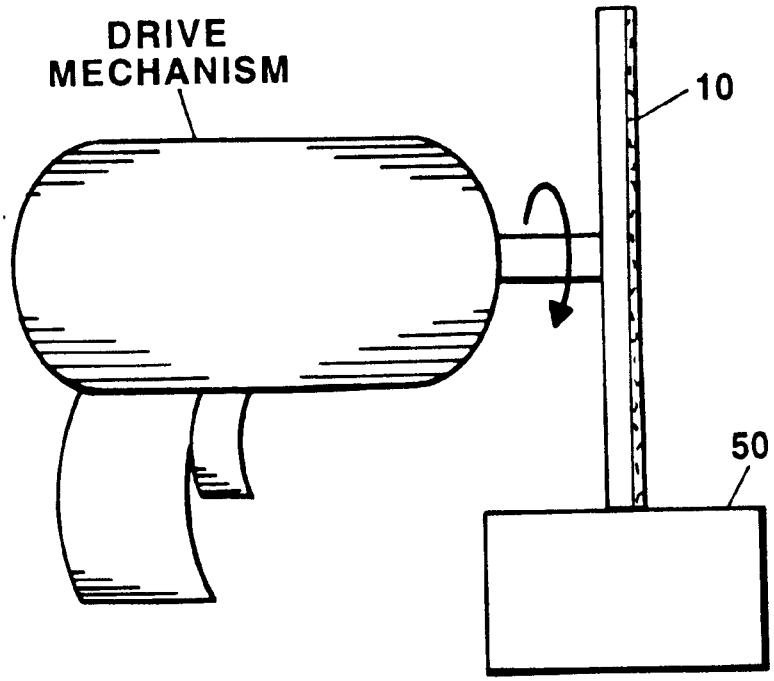
FIG. 4*d* is a side view of the abrade and cut disc being cut back on a block to expose unused abrading surface.

The abrading pad 14 is preferably made from a material that is relatively strong, tough and resistant to oils, solvents and the like, that provides a good sanding surface, such as standard sandpaper. Standard sand paper has a usual life of an hour or less, and is then replaced and disposed of because the outer radial area 33 (FIGS. 1*a* and 2) is wear or torn. The inner radial area 35 (FIGS. 1*a* and 2) of the sandpaper is still functional but there is no effective way use it. As the cutting plate 12 is cut back radially, the abrading pad 14 is also cut back to expose the lesser-used abrading surface 35 (FIGS. 1*a*, 1*b* and 2). The process to cut back the disc 10 is illustrated in FIG. 4*d* and includes holding the rotating disc 10 perpendicular to a block 50 and applying sufficient normal force to grind the cutting plate 12 and remove the worn abrasive surface 32 of abrasive pad 14. This action reduces the cutting plate diameter 16 and the abrading pad diameter 18 revealing a good abrading surface, formerly an inner radial area 35.

The abrading surface 32 comprising a variation of sand or sand-like, abrasive, coarse granular texture that vary in grain size depending on type of work to be performed. The abrading surface 32 is generally a compound mixture of sand-like, abrasive particles of various grain sizes applied to the base material of the abrading pad 14 with sufficient rigidity, strength and thickness to withstand the forces of rotation, normal loads, and frictional effects. Those who are skilled in the art of abrasive texturing are familiar with the application of the coarse granular texture to the abrading pad 14.

Different sizes of abrading pads 14, along with a matching suitable sized cutting discs 12 acting as a pressure/backing plate, may be used. The sizes dependent on the surface size or area over which imperfections are to be removed. A common size used for removal of spot imperfections would have a cutting disc 12 diameter 16 of approximately 5½" (13.75 cm) with an abrading surface diameter 18 of approximately 3½" (7.625 cm). A common size used for removal of large imperfections would have a cutting disc 12 diameter 16 approximately of 7½" (17.5 cm) with an abrading surface diameter of approximately 5½" (13.75 cm).

MODE OF OPERATION

A cutting plate 12 and abrading pad 14 are provided. The externally threaded connection 34 of the abrading pad 14 is inserted into a central hole 28 of the cutting plate 12. The abrading pad rear face 24 bears on the cutting plate front face 26. The cutter plate 12 is clamped between the abrading pad 14 and the drive mechanism D (FIGS. 4*b* and 4*c*), thereby the cutter plate 12 is joined mechanically to the abrading pad 14 by friction and a high normal force on their adjoining faces, forming the combined abrade and cut disc 10, screwed to the output shaft of the drive mechanism D. Whereby, the cutting plate 12 rotates at the same speed as the abrading pad 14.

The drive mechanism D rotates the cutting plate 12 and abrading pad 14 about their common axis of rotation R—R. Such drive mechanisms include electric sanders that operate between about 1,000 to 3,000 R.P.M.'s and air operated sanders that operate between about 1,000 and 5,000 R.P.M.'s.

Figure 4B:
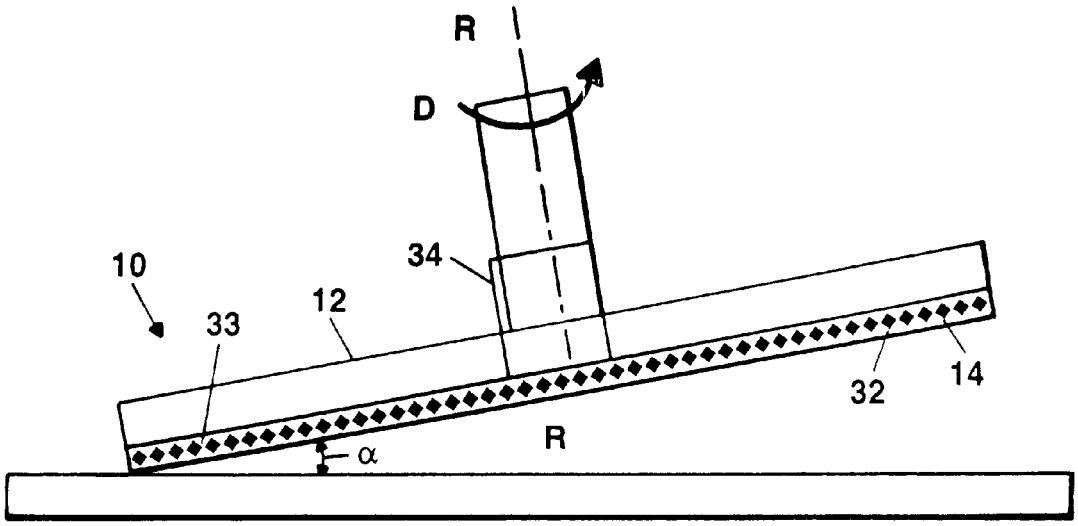
FIG. 4*b* is a side view of the abrade and cut disc sanding a work surface.

FIG. 4*b* illustrates the abrading operation where the abrade and cut disc 10 is positioned at a slight angle a (FIG. 4*b*) to a work surface such that the outer radial area 33 of the abrading pad 14 is in contact with the work surface. The drive mechanism D is turned on causing the cutting and abrading disc 10 to rotate. As the drive mechanism is moved toward the work piece and the abrading surface 32 engages the work piece, the cutting plate 12 exerts sufficient forward axial pressure. The cutting and abrading disc 10 facilitates a firm steady application of axial pressure to be directed and maintained against the work surface area by the rotating abrading surface 32.

Figure 4C:
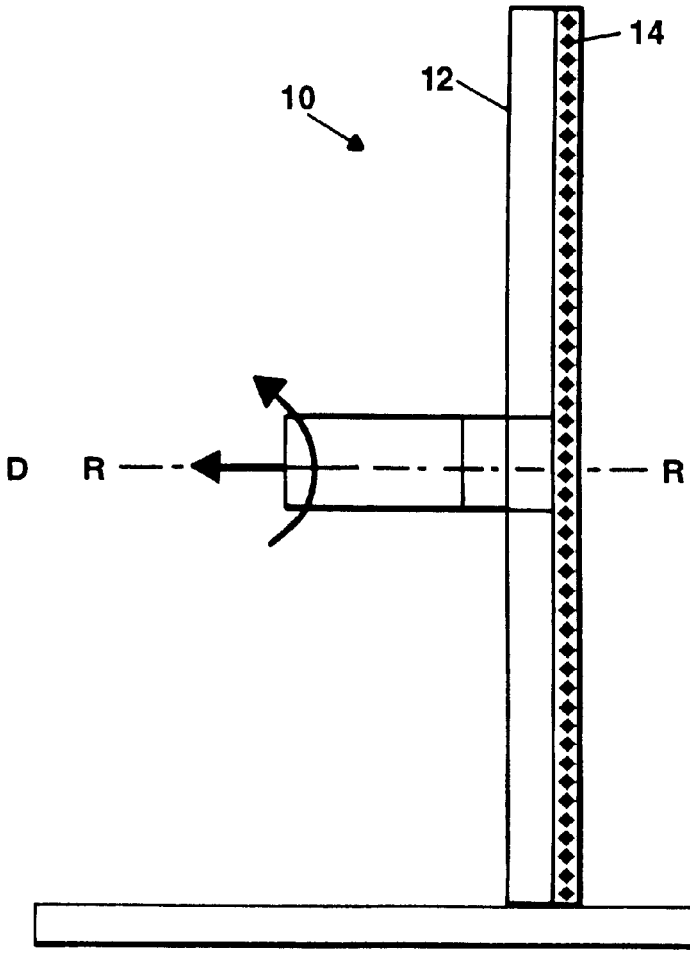
FIG. 4*c* is a side view of the abrade and cut disc cutting a work surface.

FIG. 4*c* illustrates the cutting operating where the abrade and cut disc 10 is positioned substantially perpendicular to a work surface. With sufficient normal force applied to the drive mechanism, the abrade and cut disc 10 can cut metal, plastic, and other auto-body materials.

After the work surface area has been sufficiently abraded or outer radial area 33 of the abrading pad 14 is worn, the abrading surface can be "cleaned" by holding the drive mechanism perpendicular (FIG. 4*d*) to a block 50 of sufficient hardness and roughness to remove material from the periphery of cutting plate 12 and abrading pad 14. With sufficient normal force applied to the drive mechanism, the cutting plate diameter 16 is reduced, thereby reducing the abrading pad diameter 18, cutting back to a good abrading surface, formerly an inner radial area 35.

The description below of various illustrative embodiments shown in FIGS. 5 through 8 refer to embodiments similar to those described above. However, it is not intended to limit the scope of the present invention, but merely to be illustrative and representative thereof.

Figure 5A:
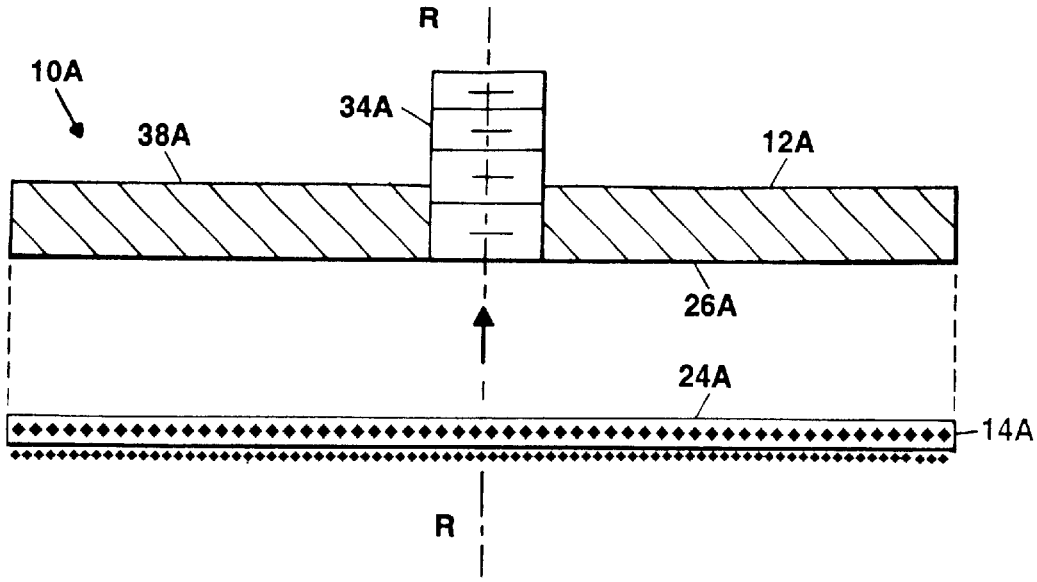
FIG. 5*a* shows an exploded partial cross-section side view of an alternative embodiment comprising an abrading pad fixedly attached to a cutting plate with a threaded connection for attachment to a drive mechanism.
Figure 5B:
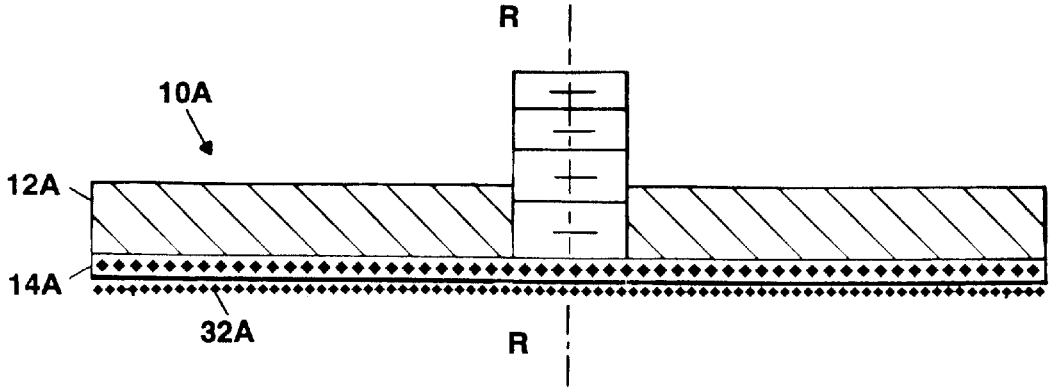
FIG. 5*b* is a side view of the alternative embodiment illustrated in FIG. 5*b* as assembled.

FIGS. 5*a* and 5*b* show an alternative embodiment 10A comprising a cutting plate 12A and abrading pad 14A. The cutting plate 12A and abrading pad 14A are essentially the same as the ones described in the preferred embodiment 10. However, the abrading pad rear face 24A is permanently attached to the cutting plate front face 26A by adhesive, welding, or other bonding means (FIG. 5*b*). Alternatively, the disc 10A may also be constructed to allow detachable fastening of the abrading pad 14A to the cutting disc 12A employing hook and loop fastening devices, mechanical fastening devices, pressure sensitive adhesives, etc. (not shown). Additionally, an externally threaded connection 34A is fixedly attached to cutting pad rear surface 38A of the cutting plate 12A instead of the abrading pad 14A. The externally threaded connection 34A can be integral to the cutting plate 12A or can be a separate part (not shown) welded or adhered to the cutting pad rear surface 38A.

Figure 6:
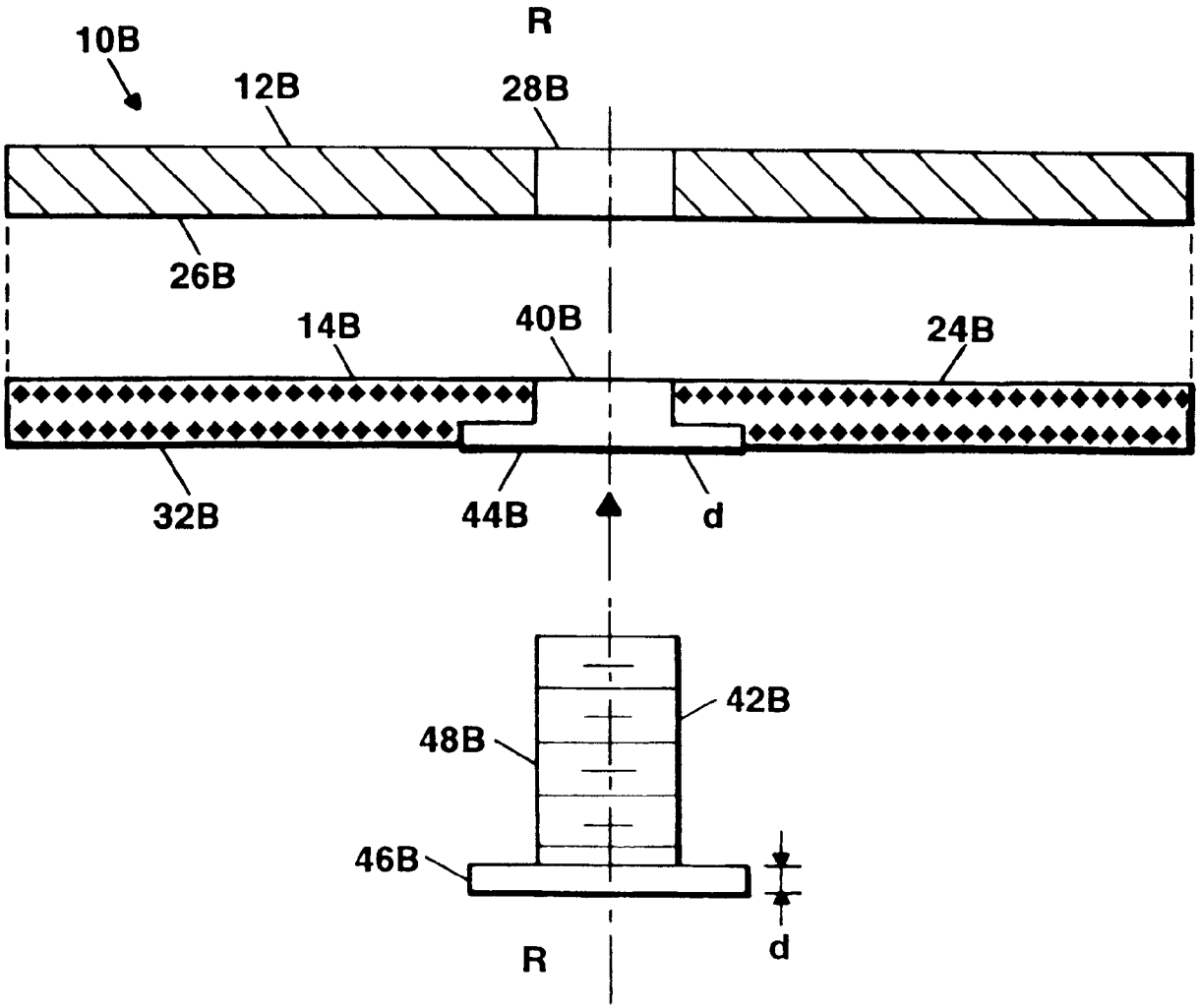
FIG. 6 shows an exploded partial cross-sectioned view of another alternative embodiment comprising a cutting plate and a abrading pad with a bolt for attachment to a drive mechanism.

FIG. 6 shows an alternative embodiment 10B comprising a cutting plate 12B and abrading pad 14B with a bolt 42B, in lieu of an integral externally threaded connection 34, for attachment to a drive mechanism. The cutting plate 12B is essentially the same as the one described in the preferred embodiment that includes a cutting plate central hole 28B. The abrading pad 14B is essentially the same as the one described in the preferred embodiment 10 except the integral externally threaded connection 34 has been replaced by an abrading pad central hole 40B, through the axis of the rotation R—R, for receiving a bolt 42B with external threads 48B, to secure the abrade and cut disc 10B to the output shaft of a drive mechanism. The abrading surface 32B comprises a counterbore 44B along axis of Rotation R—R the depth d of the bolt head 46B. The bolt 42B is recessed so there are no markings made of the work surface by contact made by the bolt head 46. The abrading pad rear face 24B bears against the cutting plate front face 26B as the bolt 42B is tightly threaded in a drive mechanism.

Figure 7:
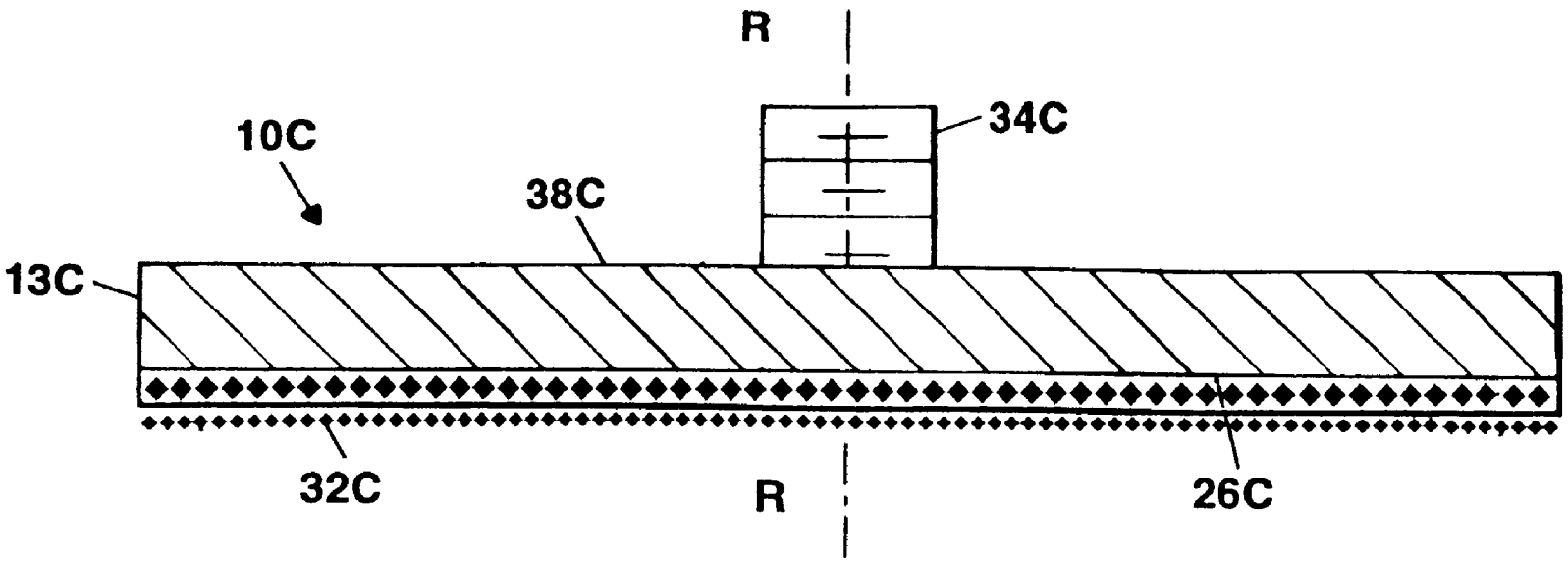
FIG. 7 shows a side view of an alternative embodiment with an integral cutting plate and abrading pad with a fixedly attached threaded connection for attachment to a drive mechanism.

FIG. 7 shows an alternative embodiment 10C comprising an integral cutting plate/abrading pad 13C, an abrading surface 32C, and an externally threaded connection 34C. The integral cutting plate/abrading pad 13C is essentially the same as the cutting plate 12 and the abrading pad 14 described in the preferred embodiment 10. The integral cutting plate/abrading pad 13C comprises an externally threaded connection 34C that is fixedly attached to cutting pad rear surface 38C along the rotational axis R—R. The externally threaded connection 34C can be integral to the integral cutting plate/abrading pad 13C or can be a separate part (not shown) welded or adhered to the cutting pad rear surface 38C. The abrading surface 32C is generally a compound mixture of sand-like, abrasive particles of various grain sizes applied to the forward face 26C of the integral cutting plate/abrading pad 13C. Those who are skilled in the art of abrasive texturing are familiar with the application of the coarse granular texture to the integral cutting plate/abrading pad 13C.

Figure 8:
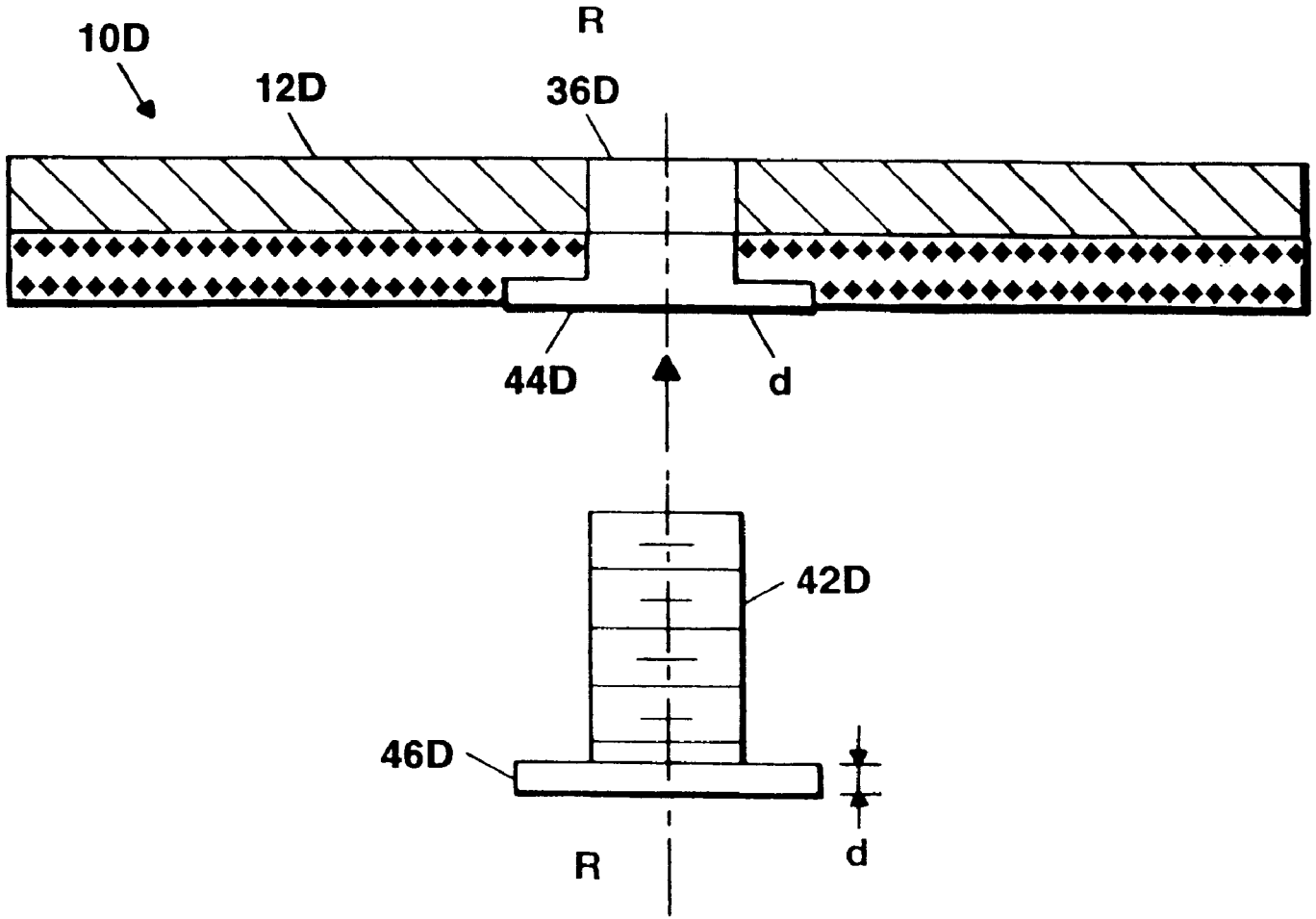
FIG. 8 shows an exploded view of an alternative embodiment comprising an integral cutting plate and abrading pad a bolt for attachment to a drive mechanism.

FIG. 8 shows an alternative embodiment 10D comprising an integral cutting plate/abrading pad 12D with a bolt 42D, in lieu of an integral externally threaded connection 34, for attachment to a drive mechanism. The integral cutting plate/abrading pad 12D is essentially the same as the cutting plate 12 and the abrading pad 14 described in the preferred embodiment 10. The integral cutting plate/abrading pad 12D has a central hole 36D with a counterbore 44D along axis of Rotation R—R. The counterbore 44D is a depth d of the bolt head 46D for receiving a bolt 42D to secure the abrade and cut disc 10D to the output shaft of a drive mechanism. The bolt 42D is recessed so there are no markings made of the work surface by contact made by the bolt head 46D.

Accordingly, it can be seen that the abrade and cut disc overcomes the disadvantages of the current art with one tool that operates as two tools for the functions of abrading and cutting such tasks as automobile body work.

Although the invention has been described with respect to various embodiments, it should be realized this invention is also capable of a wide variety of further and other embodiments within the spirit and scope of the appended claims.

What is claimed is:

1. A reducible diameter abrade and cut disc for finishing of a work surface, said disc comprising:

an abrading pad having a center, a perimeter, a diameter, a rear surface, a front surface, and abrasive material disposed upon said front surface substantially extending outward from said center to said perimeter; and a cutting plate having a front surface, a perimeter, a diameter, and a substantially smooth cutting plate edge along said cutting plate perimeter, said cutting plate edge being substantially free of projections, said cutting plate front surface being juxtaposed to said abrading pad rear surface, whereby said diameters are capable of being reduced by an amount sufficient to eliminate consumed said abrasive material thereby restoring the abrading functionality of said disc.

2. The disc as recited in claim 1, wherein said cutting plate is made of graphite.

3. The disc as recited in claim 1, wherein said abrasive material is generally a compound mixture of sand-like, abrasive particles of varying grain sizes adhered to said abrasive pad.

4. The disc as recited in claim 1, wherein said abrasive pad is sandpaper.

5. The disc as recited in claim 1, wherein said disc further includes an externally threaded connection fixedly attached to said rear surface of said abrading pad, whereby said externally threaded connection engages a drive mechanism.

6. The disc as recited in claim 5, wherein said cutting plate further comprises a hole through its center of rotation, said hole having a predetermined diameter for said externally threaded connection to fit securely within said hole of said cutting plate, whereby said externally threaded connection passes through said hole to engage the drive mechanism.

7. The disc as recited in claim 1, wherein said cutting plate is generally planar and circular in shape.

8. The disc as recited in claim 1, wherein said abrasive pad is generally planar and circular in shape.

9. The disc as recited in claim 1, wherein said cutting plate is attached to said abrading pad.

10. The disc as recited in claim 1, wherein said cutting plate is made of a material of predetermined hardness, whereby said cutting plate edge is capable of being radially cut back when said cutting plate edge contacts an object made of material harder than said predetermined hardness.

11. A reducible diameter abrade and cut disc, said disc comprising:

a cutting plate, said cutting plate being generally planar and circular in shape, said cutting plate having an edge surface being substantially free of projections and a center hole along an axis of rotation of said disc;

an abrading pad, said abrading pad being generally planar and circular in shape, having an edge surface, an abrading surface and a rear surface; and connection means for attaching said disc to a drive mechanism, said connection means being attached to said abrading pad rear surface and having peripheral dimensions sufficiently sized to be received by said cutting plate center hole, such that said cutting plate is capable of being dispose between said abrading pad and the drive mechanism, whereby said edge surfaces are capable of being worked to eliminate consumed said abrading surface thereby restoring the abrading functionality of said disc.

12. The abrade and cut disc as recited in claim 11, wherein said connection means comprises an externally threaded member attached to said rear surface perpendicular to said planar abrading pad, said threaded connection having a predetermined diameter to fit securely within said cutting plate hole.

13. The abrade and cut disc as recited in claim 11, wherein said abrading pad is sandpaper.

* * * * *